US008925593B2

(12) United States Patent
Lamboux

(10) Patent No.: US 8,925,593 B2
(45) Date of Patent: Jan. 6, 2015

(54) BOTTLE FILLING DEVICE

(75) Inventor: Jean-Philippe Lamboux, Saint Didier des Bois (FR)

(73) Assignee: Techniplast, Louviers (FR)

( * ) Notice: Subject to any disclaimer, the term of this patent is extended or adjusted under 35 U.S.C. 154(b) by 159 days.

(21) Appl. No.: 13/419,458

(22) Filed: Mar. 14, 2012

(65) Prior Publication Data

US 2012/0234432 A1 Sep. 20, 2012

(30) Foreign Application Priority Data

Mar. 14, 2011 (FR) ..... 11 52039

(51) Int. Cl.

| | |
|---|---|
| ***B65B 3/06*** | (2006.01) |
| ***B65B 39/00*** | (2006.01) |
| ***A45D 34/02*** | (2006.01) |
| ***B65B 39/04*** | (2006.01) |
| ***B05B 11/00*** | (2006.01) |

(52) U.S. Cl.

CPC ..... *B65B 39/003* (2013.01); *A45D 34/02* (2013.01); *B65B 3/06* (2013.01); *B65B 39/04* (2013.01); *B05B 11/0097* (2013.01)

USPC ..... 141/18; 141/285; 141/383

(58) Field of Classification Search

CPC ..... B65B 3/06; B65B 39/00

USPC ..... 141/285, 291, 301, 319, 346–349, 141/363–366, 18, 383

See application file for complete search history.

(56) References Cited

U.S. PATENT DOCUMENTS

| | | | | | |
|---|---|---|---|---|---|
| 4,060,105 | A | * | 11/1977 | Feldeisen et al. | 141/1 |
| 4,313,477 | A | * | 2/1982 | Sebalos | 141/301 |
| 4,538,653 | A | * | 9/1985 | Shea et al. | 141/285 |
| 5,474,113 | A | * | 12/1995 | Rademacher et al. | 141/31 |
| 5,477,895 | A | * | 12/1995 | Willard | 141/22 |
| 5,947,171 | A | * | 9/1999 | Woodruff | 141/346 |
| 6,050,309 | A | * | 4/2000 | Woodruff | 141/346 |

(Continued)

FOREIGN PATENT DOCUMENTS

| | | |
|---|---|---|
| FR | 2 867 761 A1 | 9/2005 |
| GB | 2 279 069 A | 12/1994 |

(Continued)

OTHER PUBLICATIONS

French Search Report, dated Dec. 20, 2011, from corresponding French application.

*Primary Examiner* — Timothy L Maust
*Assistant Examiner* — Andrew Schmid
(74) *Attorney, Agent, or Firm* — Young & Thompson

(57) ABSTRACT

Device for recharging a bottle with liquid, includes: a refill containing the liquid, and a decanting system, adapted selectively to pass the liquid from the refill to the bottle, the decanting system including: a first part fixed to the refill and having a first liquid passage and a first air passage in communication with the refill; a second part connected to the first part, and intended to be fixed to the bottle, the second part including a second liquid passage and a second air passage intended to communicate with the bottle, the first and the second parts structured to move together in translation and free to rotate between an open configuration, in which the first and second liquid and air passages are aligned, providing passage of liquid and air between the refill and the bottle, and a closed configuration, in which they are not aligned, preventing liquid and air passage.

18 Claims, 5 Drawing Sheets

(56) References Cited

U.S. PATENT DOCUMENTS

| | | | | |
|---|---|---|---|---|
| 6,085,809 | A * | 7/2000 | Woodruff | 141/346 |
| 6,263,928 | B1 * | 7/2001 | Woodruff | 141/346 |
| 6,305,444 | B1 * | 10/2001 | Woodruff | 141/346 |
| 6,363,235 | B1 * | 3/2002 | Chiesa et al. | 399/258 |
| 6,457,899 | B1 * | 10/2002 | Lin | 403/305 |
| 6,772,807 | B1 * | 8/2004 | Tang | 141/352 |
| 6,938,650 | B2 * | 9/2005 | Mitchell | 141/59 |
| 7,210,508 | B2 | 5/2007 | Behar | |
| 2002/0179179 | A1 * | 12/2002 | Volpenheim et al. | 141/381 |
| 2003/0030278 | A1 * | 2/2003 | Shimei et al. | 285/331 |
| 2003/0234062 | A1 * | 12/2003 | Wei | 141/319 |
| 2004/0187959 | A1 * | 9/2004 | Woodruff | 141/347 |
| 2007/0277902 | A1 * | 12/2007 | Dieudonat et al. | 141/319 |
| 2012/0103468 | A1 * | 5/2012 | Terwilliger et al. | 141/346 |
| 2012/0186698 | A1 * | 7/2012 | Fehr et al. | 141/346 |

FOREIGN PATENT DOCUMENTS

| | | | |
|---|---|---|---|
| GB | 2 396 318 | A | 6/2004 |
| JP | 20041306982 | A | 11/2004 |
| JP | 20071182255 | A | 7/2007 |

* cited by examiner

BOTTLE FILLING DEVICE

BACKGROUND OF THE INVENTION

1. Field of the Invention

The present invention relates to the field of decanting a liquid present in a first container into an empty bottle. In particular, the present invention provides a device for recharging a liquid product, such as a perfume.

The present invention also provides the use of such a recharging device for filling a bottle from another, so-called recharging bottle.

2. Description of the Related

ArtA number of products are sold in bottles having a luxurious character. These bottles have numerous aesthetic motifs that are relatively difficult to manufacture, for example, and may moreover be produced in noble materials, thus increasing their cost. The luxurious character of a bottle adds value to the contents, which are also costly, and enhances the image of the product. This is the case with perfume bottles in particular. Accordingly, the use of a refilling bottle of less value than the product it contains makes it possible to refill and to reuse a luxurious bottle which, because of its quality, is generally perceived as a non-disposable object.

It may also be useful to decant a product from a relatively basic bottle (refill) into a more luxurious bottle or one that is more presentable in order to address an environmental concern, for example if the refill can be recycled, or to address economic concerns.

Perfume bottles are typically constituted of a container having a threaded neck onto which a spray head is screwed. Similarly, refill bottles generally comprise a container having a threaded neck onto which a threaded stopper is screwed.

A simple way recharge or fill an empty perfume bottle is to unscrew the atomizer head and to decant the contents of the refill manually, after unscrewing the stopper.

This has drawbacks, however. Given that the neck of said refillable dispenser is typically small, some manual skill or dexterity is required to effect the decanting or transfer of perfume from a refill bottle to the perfume bottle. Except for the highly skilled person, the usual consequences of decanting are on the one hand a loss of the product contained in the refill, often a costly perfume, and on the other hand a risk of soiling of the clothes or hands, with the attendant risk of the tenacious or durable odour associated with such an operation, the product or perfume having been able to spill and impregnate a fabric.

In the prior art, in addition to manual decanting, there are also known devices in the form of funnels. A funnel is a conical instrument, terminated by a tube, that is used to pour not only a liquid, but also a powder, a granulate or a paste, for example into a container with a smaller opening. The funnel is generally in glass, plastic or metal.

The documents GB 2 396 318, JP 2007/182255 and JP2004/306982 describe improved funnels. For example, the first document describes a funnel device including flotation means for blocking the cone of the funnel in order to prevent the product overflowing during decanting.

However, with such funnel devices, the user may be splashed by drops of the product to be recharged during decanting, the consequence of which is to cause loss of product and soiling of the user.

The document FR 2 867 761 describes a device for recharging a container provided with a threaded neck comprising: a) a first container intended to contain a product to be transferred into the second container, b) cooperation means intended to connect said first and second containers, c) means for shutting off the second container, and d) means for transferring the product contained in the first container to the second container. This device enables the transfer from a full (refill) bottle to an empty bottle to be filled with the same capacity as the refill. Thus if liquid remains in the bottle to be filled, the refill cannot be completely emptied into the bottle. Consequently, on uncoupling the refill from the bottle, the liquid still present in the refill will overflow, which will lead to losses.

BRIEF SUMMARY OF THE INVENTION

An object of the present invention is to propose a new recharging device that avoids some or all of the problems referred to above.

To this end, the invention provides a device for recharging a bottle with liquid, characterized in that it comprises:

a refill containing the liquid, and a decanting system, adapted selectively to pass the liquid from the refill to the bottle, said decanting system comprising:

a) a first part fixed to the refill, and comprising a first liquid passage and a first air passage, in communication with the refill, b) a second part connected to the first part, and intended to be fixed to the bottle, said second part comprising a second liquid passage and a second air passage intended to communicate with the bottle, the first part and the second part being constrained to move together in translation and free to rotate between a so-called open configuration, in which said first and second liquid and air passages, respectively, are aligned, thus providing for the passage of liquid and air between the refill and the bottle, and a so-called closed configuration, in which said first and second liquid and air passages, respectively, are not aligned, thus preventing the passage of liquid and air between the refill and the bottle.

The features of the device of the invention give it the advantage of being an alternative to the funnel that prevents spilling the liquid. Moreover, the liquid is never in contact with the user. Moreover, the recharging device is anti-overflow. Also, the flow is stopped automatically when the bottle to be filled is full, i.e. when the air conduit is blocked by the liquid.

Said second passages preferably have the same length and the length of the first liquid passage is less than the length of the first air passage, thus simultaneously ensuring the passage of liquid from the refill to the bottle and the passage of air from the bottle to the refill in the open configuration of the recharging device. Because said second passages are the same length, in an open configuration of the device, when the liquid level in the bottle has reached the lower end of these passages, the flow of air and of liquid is simply stopped. Accordingly, as a function of the shape of the bottle to be filled, said second passages will be longer or shorter. For example, if the bottle to be filled is long and thin, the second passages will be relatively long so as to discharge inside the bottle at the level where the user wishes the liquid to stop. If the bottle to be refilled is wide and flat, the second passages will be shorter, so as to enable convenient refilling of the bottle.

The second part advantageously comprises at least one thread for screwing the recharging device to the bottle and unscrewing it.

The first part preferably comprises at least one gadroon adapted, in the closed configuration of said device, to cooperate with at least one retractable lug present on the second part, so that, during screwing, the first part drives rotation of said second part.

Locking means are advantageously disposed in an area of the second part intended to be in contact with the upper end of the bottle, in such a manner as to stop the rotation of the second part relative to the bottle when the upper end of the bottle reaches the locking means.

The first part preferably comprises at least one screwing abutment adapted to cooperate with at least one first abutment present on the second part to block rotation of the first part when the screwing abutment comes into contact with said first abutment, the first and second air and liquid passages, respectively, being disposed in such a manner as to be aligned when the screwing abutment comes into contact with the first abutment of the second part, the screwing abutment being disposed at a different level from the at least one gadroon.

In particular, the first part comprises at least one unscrewing abutment adapted to cooperate with at least one second abutment present on the second part so that, during unscrewing and once the unscrewing abutment is in contact with the second abutment, rotation of the first part drives rotation of the second part.

The second part is preferably constrained to move in translation with the first part by clipping means.

The second part advantageously comprises a receiving space comprising the thread and shutting off means extending at least inside said receiving space, said shutting off means being adapted to be nested inside a neck of the bottle and comprising said second passages to enable, in the open configuration, the passage of liquid and air into the bottle.

In particular, the first part comprises a first receiving area having a thread into which is screwed a threaded neck present on the refill.

The first part preferably comprises anti-unscrewing means for preventing disassembly of the refill and said first part.

The first part preferably comprises a second receiving area adjacent said first receiving area along the longitudinal axis of said first part, characterized in that said first liquid passage lies in the second receiving area, and said first air passage lies both in the first receiving area and the second receiving area.

In said second receiving area, said first air passage and said first liquid passage are advantageously surrounded by an air manifold adapted, in a closed configuration, to communicate with said second air passage and said second liquid passage.

The present invention further consists in the use of a refilling device as described above to fill at least one bottle with a liquid.

BRIEF DESCRIPTION OF THE DRAWINGS

The invention will be better understood and other objects, details, features and advantages thereof will become more clearly apparent in the course of the following description of one particular embodiment of the invention, given by way of nonlimiting illustration only and with reference to the appended drawings.

In the drawings.

DETAILED DESCRIPTION OF THE PREFERRED EMBODIMENTS

Figure 2:
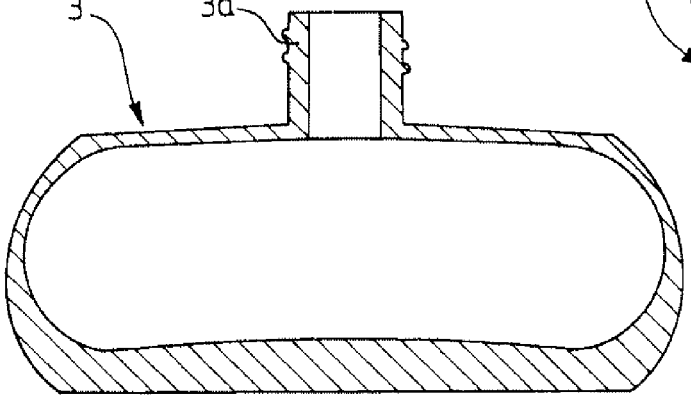
FIG. 2 represents a view in longitudinal section of a bottle adapted to be screwed onto the FIG. 1 decanting system.
Figure 1:
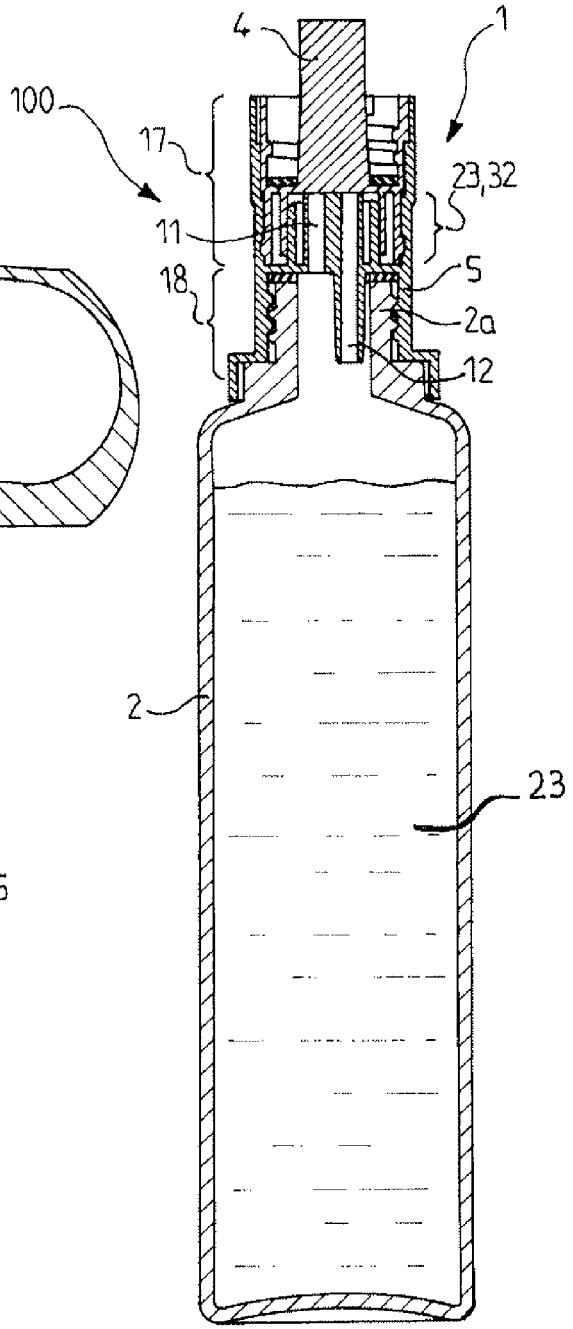
FIG. 1 represents a view in longitudinal section of a recharging preferably device of one embodiment of the present invention comprising a decanting system fixed to a refill.

As indicated above, and referring to FIGS. 1 and 2, the present invention concerns a device 100 for recharging with liquid a bottle such as a perfume bottle 3. This recharging device 100 comprises firstly a first container 2, called a refill, and a decanting system 1 that is adapted to be screwed onto a threaded neck 3*a* of the perfume bottle 3.

The refill container 2 is commonly a glass or plastic bottle or cylindrical tube filled with a liquid 23, such as perfume. The refill container 2 has a threaded neck 2*a*. It generally also has a relatively large capacity so as to be able to fill a plurality of empty perfume bottles 3.

The decanting system 1 is disposed on the neck 2*a* of the refill container 2. It is composed of two main parts: a first external part 5, which is substantially cylindrical, and a second internal part 4, which is also substantially cylindrical and partially inserted in the external part 5 in a coaxial manner, the two internal part 4 and external part 5 being constrained to move together in translation. The neck 2*a* of the refill container 2 is fixed to the decanting system 1 via the external part 5. As described hereinafter, the decanting system 1 also comprises at least one seal 30, 40, preferably two seals.

Figure 3:
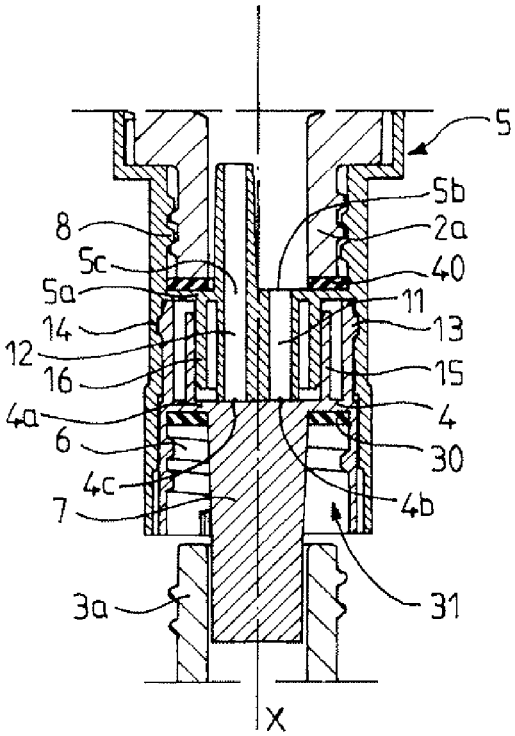
FIG. 3 is a view in longitudinal section of the FIG. 1 decanting system in a closed configuration before the bottle is screwed onto said decanting system.
Figure 16:
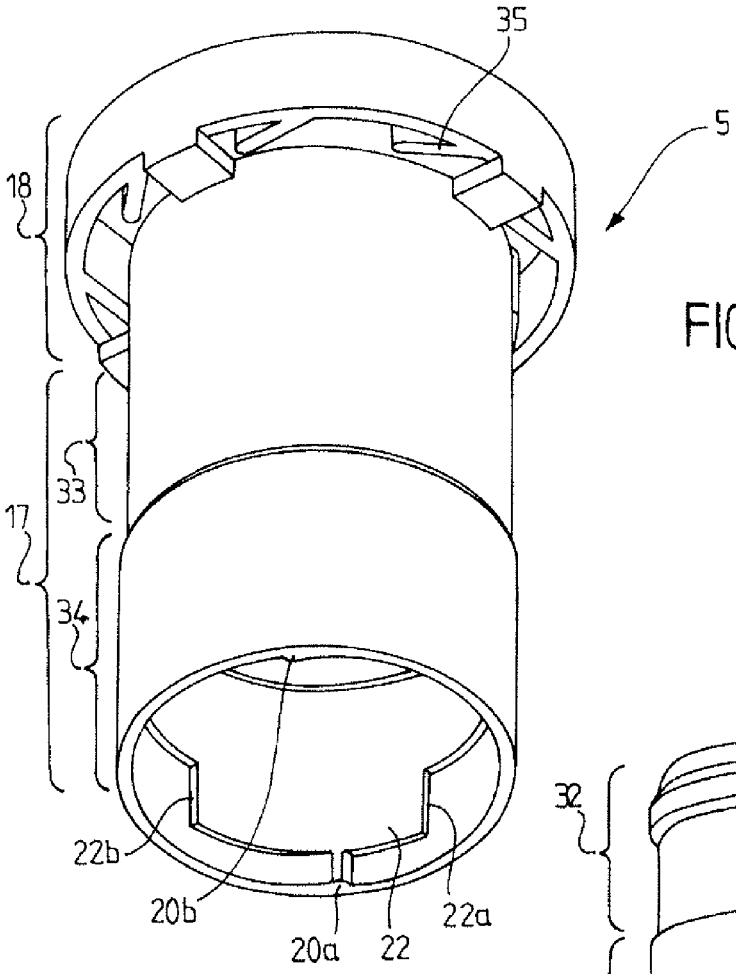
FIG. 16 is a perspective view of a first part, called the external part, of the decanting system.

The external part 5 that is shown in FIGS. 1, 3 and 16 in particular comprises two receiving areas: a first receiving area 18 (FIG. 1) that serves to receive the threaded neck 2*a* of the refill container 2 (called the refill receiving area) and a second reception area 17 (FIG. 1) that serves to receive the internal part 4 (called the internal portion receiving area). These two receiving areas 17, 18 are adjacent and in succession along the longitudinal axis (axis X) of the external part 5. They are separated by a transverse plate 5*a* that includes two orifices 5*b*, 5*c* in order to form or to have passed through them, respectively, a liquid passage 11 and an air passage 12, inside the external part 5.

The first receiving area 18 is a substantially cylindrical refill receiving area that comprises two portions, a first portion that extends in a first direction along the axis X from the transverse plate 5*a* and a second portion that extends in the same direction as the first and starting therefrom. This second portion has a wider section to receive the shoulder of the refill container 2 while the first portion includes a thread 8 that serves to screw the neck 2*a* of the refill container 2 to the external part 5. Between the transverse plate 5*a* and the neck 2*a* there is preferably disposed a seal 40. Furthermore, at the level of the interior wall of the end of the external part 5 connected to the refill container 2, anti-unscrewing means 35 prevent removal of the refill container 2 from the decanting system 1 once the latter is mounted. The fact that the device 100 is not demountable enables tracking of the product (perfume) contained in the refill container 2.

The second reception area area 17, also of substantially cylindrical shape, also comprises two portions: a first portion 33 that extends from the transverse plate 5*a* along the axis X in a second direction opposite the first direction mentioned above, and a second portion 34 which extends from and in the same direction as the first portion 33. The first portion 33 comprises in the wall of the external part 5 clipping means (groove 14) for clipping it to the internal part 4. The second portion 34 comprises at its end at the greatest distance from the plate 5*a*, first two diametrically opposite first and second gadroons 20*a*, 20*b*, then two diametrically opposite abutments 22 each including a screwing abutment 22*a* and an unscrewing abutment 22*b* (FIG. 16). These first and second gadroons 20*a*, 20*b* and abutments 22 are disposed in the internal face of the cylindrical wall of the external part 5, but not at the same level, the abutments 22 here being slightly above the gadroons. The first and second gadroons 20*a*, 20*b* also have the function of cooperating with first and second lugs 19*a*, 19*b*, respectively, on the internal part 4, and the two abutments 22 of the external part 5 have the function of cooperating with first and second abutments 21*a* and 21*b* present on the internal part 4, so that the external part 5 is able to drive rotation of the internal part 4. The second portion 34 has a section slightly greater than that of the first portion 33.

Furthermore, the external part 5 comprises two passages, a liquid passage 11 and an air passage 12. The liquid passage 11 extends from the orifice 5*b* in the transverse plate 5*a* into the second reception area area 17 of the internal part 4 and in particular as far as the end of the first portion 33 of this second reception area 17. This air passage extends from the orifice 5*a*, on either side of the plate 5*a*, both into the first receiving area area 18 and into the second reception area 17, and in particular into the first portion of the first receiving area 18 and into the first portion 33 of the second reception area 17. Thus the air passage 12 is longer than the passage 11 adapted to have a liquid passed through it. These two passages 11 and 12 are arranged so that their first ends discharge inside the neck 2*a* of the refill container 2 and their second ends discharge in line with shutting off means 7, also having two passages 9, 10, disposed on the internal part 4.

The external part 5 also includes a cylindrical wall 16 disposed around the passages 11, 12 and that extends from the transverse plate 5*a*, partially into the first portion 33 of the second reception area 17 of the internal portion. This wall 16 is adapted to cooperate with another cylindrical wall 15 disposed in the internal part 4 in order to form an air manifold 26 for the decanting system 1.

Figure 17:
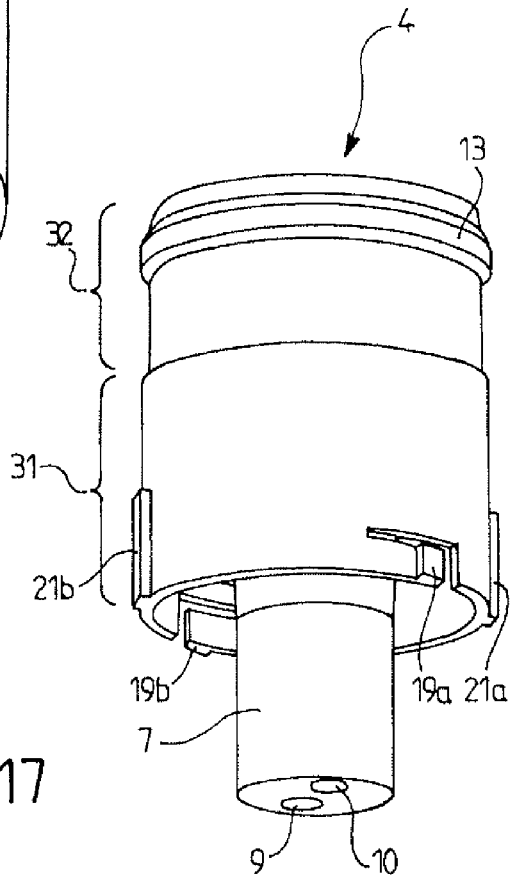
FIG. 17 is a perspective view of a second part, called the internal part, of the decanting system.

As shown in FIG. 17, the internal part 4 also comprises two portions: a first portion 32 comprising clipping means, namely a rib 13 adapted to be clipped into the groove 14 of the external part 5, and a second portion 32 notably comprising a space for receiving the neck 3*a* of the perfume bottle 3. These two portions 32, 31 are adjacent and in succession along the longitudinal axis (axis X) of the internal part 4. They are separated by a transverse plate 4*a* which, like the plate 5*a*, has two orifices 4*b*, 4*c* in order to form, respectively: a liquid passage 10 and an air passage 9 inside the internal part 4.

Figure 12:
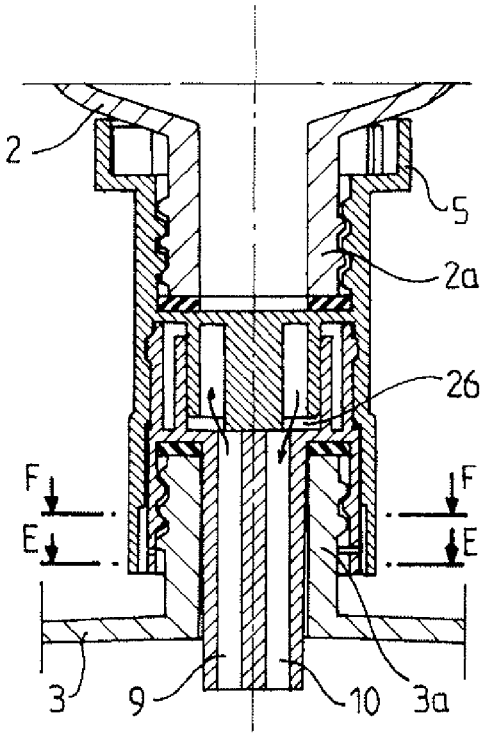
FIG. 12 is a view in longitudinal section of the FIG. 1 decanting system in a closed configuration before the bottle is unscrewed from said decanting system.

The first portion 32 extends from the transverse plate 4*a* into the first portion 33 of the second reception area 17 of the internal portion. The external wall of the internal part 4 nests in the internal wall of the portion 33 of the part 5 and is fixed via the clipping action of the rib 13 and groove 14. As stated above, the internal part 4 comprises a cylindrical wall 15. This wall 15 extends from the plate 4*a* into the portion 32 in such a manner as to surround the cylindrical wall 16 of the external part 5. Thus an air manifold 26 is formed. As may be seen in FIG. 12, when the passages 9 and 10 of the internal part 4 are not facing the passages 11 and 12 of the external part 5, they discharge into the air manifold 26.

The second portion 31 comprises in its internal wall a thread 6 adapted to cooperate with the neck 3*a* and enabling the bottle 3 to be screwed onto the recharging device 100. Between the neck 3*a* and the plate 4*a* there is disposed a seal 30 (of washer shape) in order to provide a seal between the bottle and the decanting system 1. As FIG. 17 shows, the internal part 4 comprises the two diametrically opposite first and second retractable lugs 19*a* and 19*b* that are disposed on the external wall of the internal part and in particular at the level of the end of the second portion 31 at the greatest distance from the first portion 32. At the same level there are also the two diametrically opposite abutments 21*a* and 21*b* adapted to cooperate with the screwing and unscrewing abutments 22*a*, 22*b* of the external part 5. Moreover, as mentioned above, the internal part 4 comprises shutting off means 7. These shutting off means extend from the plate 4*a* toward the receiving area of the bottle (toward the second portion 31), so as to be able to fit into and shut off the neck 3*a*. These shutting off means include two passages: a liquid passage 10 and an air passage 9. These two passages 9, 10 have the same length and are adapted, as a function of the rotation of the external part 5 relative to the internal part 4, to be aligned with the air passage 12 and the liquid passage 11, respectively, of the external part 5. If the passages of the external and internal parts are aligned, the recharging device 100 is referred to as being in an open configuration, whereas when these passages are not aligned, the recharging device 100 is said to be in a closed configuration. The operation of said recharging device 100 is described next with reference to FIGS. 1 to 19.

In FIG. 1, the refill carries the first external part 5. The second internal part 4 is housed in the first external part 5 in the closed configuration.

The first operation to be effected by the user (see FIG. 3) is to screw the first external part 5 of the recharging device onto neck 3*a* of the bottle by the shutting off means 7 being introduced into the neck 3*a* of the bottle before the first external part 5 of the recharging device is screwed on.

Figure 4:
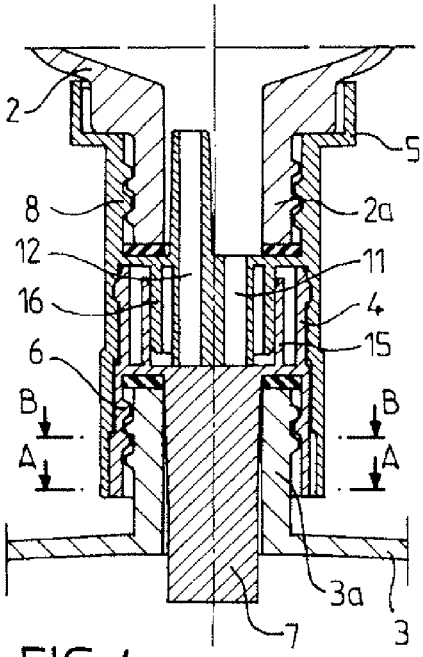
FIG. 4 is a view in longitudinal section of the FIG. 1 decanting system in a closed configuration with the bottle screwed onto said decanting system.
Figure 5:
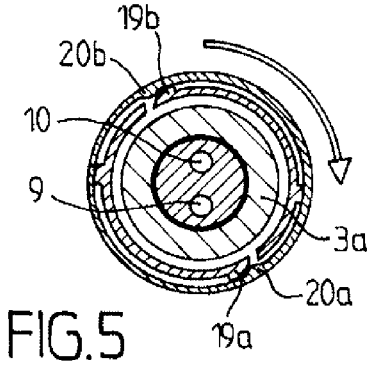
FIG. 5 is a view in section taken along the line A-A in FIG. 4.
Figure 8:
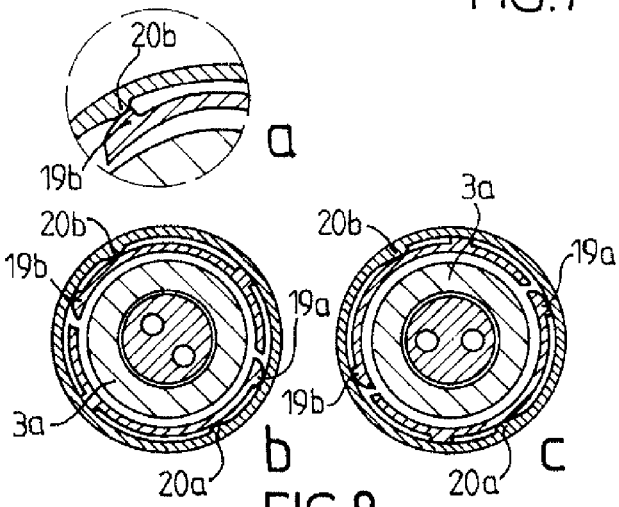
FIG. 8 is a view in section taken along the line C-C in FIG. 7, FIG. 8*a*) representing an enlarged view of the interaction between a retractable lug and a gadroon of the decanting system, FIG. 8*b*) representing a view during rotation and FIG. 8*c*) representing a view after rotation.
Figure 6:
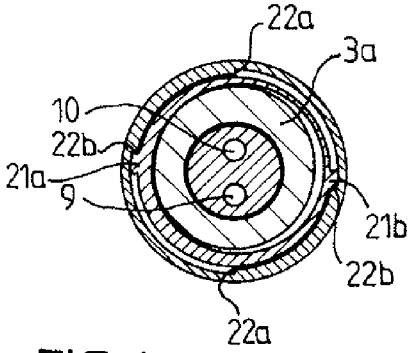
FIG. 6 is a view in section taken along the line B-B in FIG. 4.

During this action, the external part 5 drives rotation of the internal part 4. Referring to FIGS. 4 to 6, the first and second gadroons 20*a*, 20*b* of the external part drive rotation of the internal part 4 through contact with the first and second retractable lugs 19*a* and 19*b*, respectively, of said internal part 4. During this step, the internal and external parts 4, 5 are in the closed configuration (see FIGS. 3 to 6). Thus no liquid flows (the liquid and air passages of the internal and external parts are not aligned).

Figure 7:
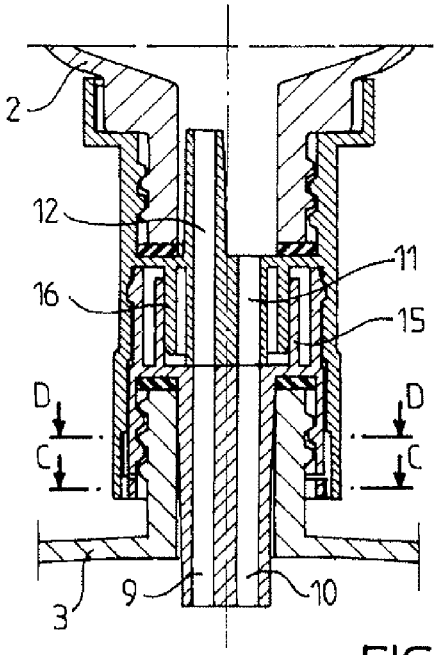
FIG. 7 is a view in longitudinal section of the FIG. 1 decanting system in an open configuration.
Figure 9:
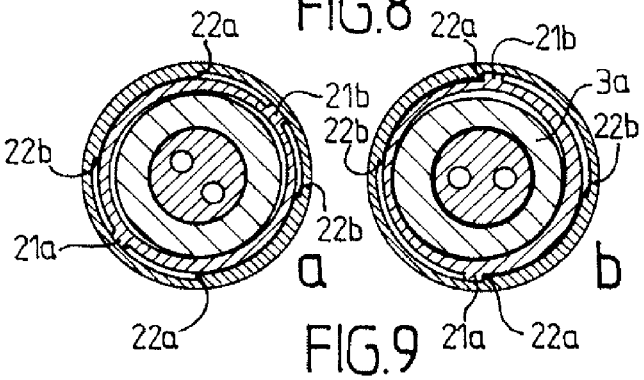
FIG. 9 is a view in section taken along the line D-D in FIG. 7, FIG. 9*a*) representing a view during rotation and FIG. 9*b*) representing a view after rotation.
Figure 10:
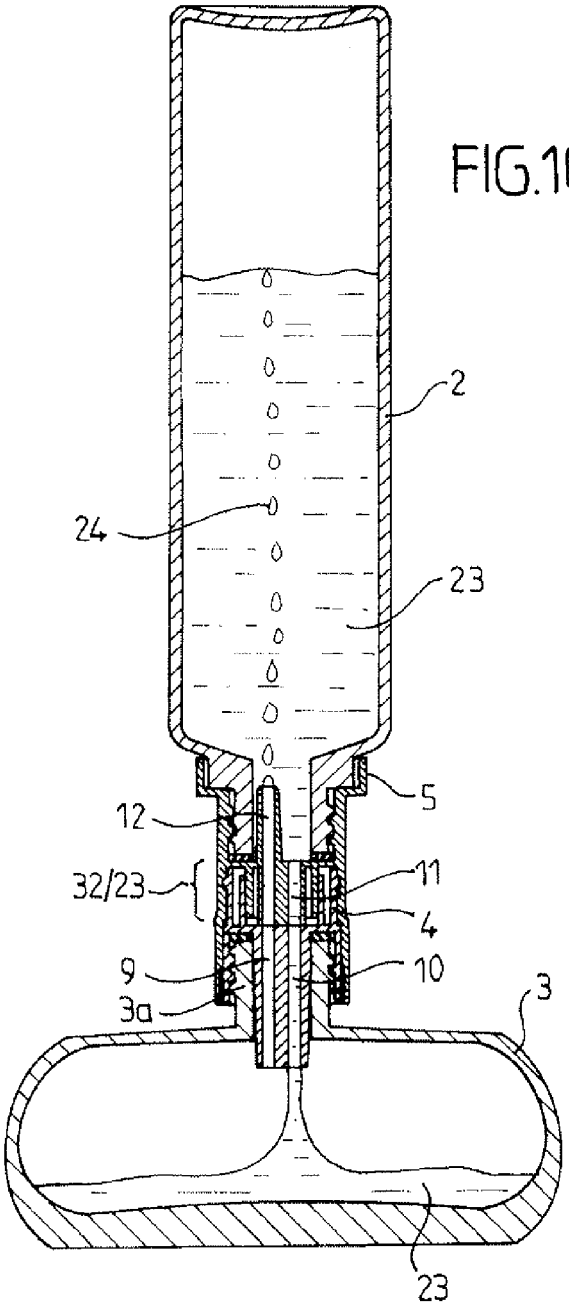
FIG. 10 is a view in longitudinal section of the FIG. 1 recharging device when the decanting system is in an open configuration and the liquid is flowing from the refill to the bottle.

At the end of screwing the recharging device 100 onto the perfume bottle 3, the elastomer seal 30 (labelled in FIG. 3) comes into contact with the neck of the bottle 3 (FIG. 4). This seal 30 prevents the internal part 4 from turning relative to the bottle 3 and from being driven by the external part 5. The rotation of the internal part 4 is blocked. As shown in FIGS. 7 and 9, when the neck 3*a* has reached the seal 30, the rotation of the internal part 4 is blocked, the first and second retractable lugs 19*a* and 19*b* of this part retracting under the first and second gadroons 20*a* and 20*b* (FIGS. 8*a* to 8*c*) of the external part 5.

The user continues to turn the external part 5 around the internal part until the first abutment 22*a* of the external part abuts against a first abutment 21*a* of the internal part (rotation of ¼ turn—FIGS. 9*a* and 9*b*) thus aligning the liquid passages 10 and 11 and air passages 9 and 12 of the two parts, the device 100 from now on being in the open configuration (FIG. 7).

Liquid can thus flow from the refill container 2 to the perfume bottle 3 to be filled (FIG. 10) by gravity alone. The air expelled by filling the bottle is transferred into the refill container 2 to compensate the drop in pressure generated by the flow of the liquid 23 from the refill container 2 to the bottle 3. The difference in length between the air passage 12 and the liquid passage 11 causes air to rise through the passage 12 and liquid to flow through the passage 11.

Figure 11:
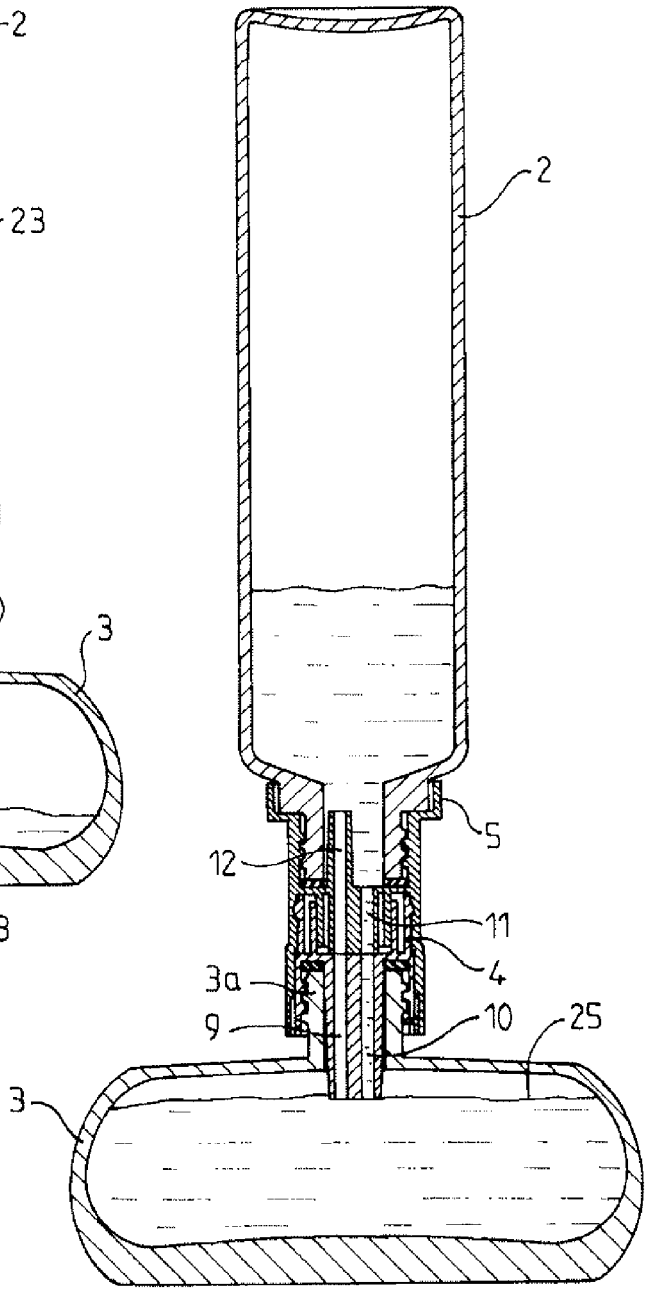
FIG. 11 is a view in longitudinal section of the FIG. 1 recharging device when the decanting system is in the open configuration and the liquid is no longer flowing from the refill to the bottle.

When, as shown in FIG. 11, the liquid level 25 is reached and this shuts off the air passage 9, the air 24 can therefore no longer flow and pass from one container to the other. Flow is thus stopped automatically, because the volume of liquid can no longer be compensated by a volume of air, the pressure is reduced, the liquid no longer flows. At the end of this step, the bottle 3 is filled with perfume. Adjusting the length of the passages 9 and 10 also enables adjustment of the filling level of the bottle as a function of its shape.

Figure 15:
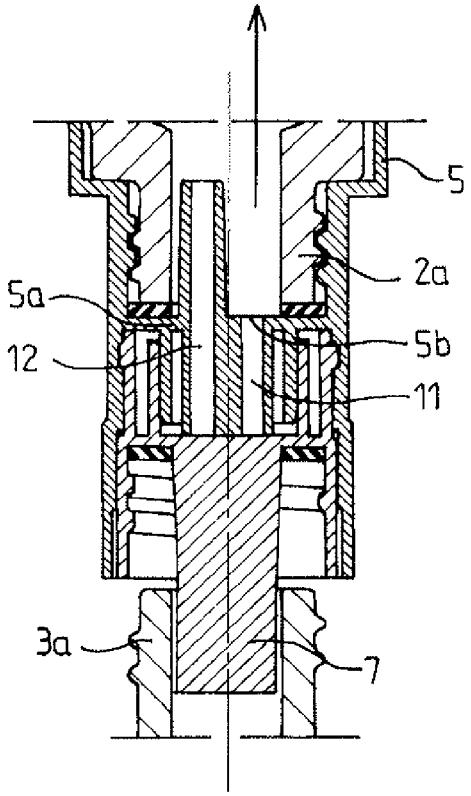
FIG. 15 is a view in longitudinal section of the FIG. 1 decanting system in a closed configuration and with the bottle unscrewed from said decanting system.
Figure 13:
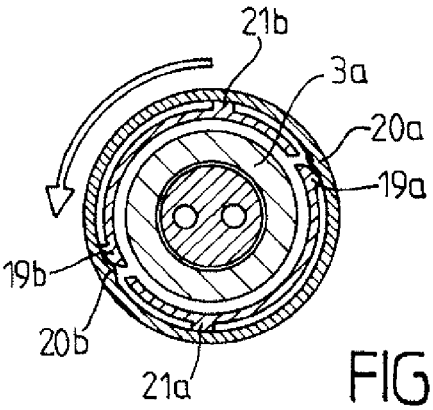
FIG. 13 is a view in section taken along the line E-E in FIG. 12.
Figure 14:
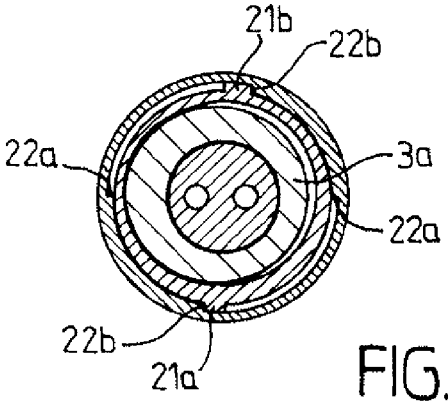
FIG. 14 is a view in section taken along the line F-F in FIG. 12.

Once the bottle 3 has been filled (FIGS. 12 to 14), the user unscrews the recharging device 100 from the bottle 3. For this, initially, the adhesion of the seal 30 to the neck 3*a* of the bottle 3 prevents rotation of the interior part 4, and it is therefore the exterior part 5 that pivots about the interior part 4 during one quarter-turn in the unscrewing direction. This quarter-turn movement eliminates the alignment of the air passages 9 and 12 and the liquid passages 10 and 11. The device 100 is again in the closed configuration. Then, in a second period, the second unscrewing abutment 22*b* of the external part 5 abuts against a second abutment 21*b* of the internal part 4 and drives rotation of the internal part 4, the internal part 4 no longer being immobilized by the seal 30. The starting position shown in FIG. 15 is returned to.

During unscrewing, the decanting system 1 moves away from the liquid level 25, thus unblocking the air passage 9. Accordingly, in the closed position, the two passages 9 and 10 situated in the internal part 4 and the air that is present communicate via the air manifold 26. The liquid stagnating in the liquid passage 10 is therefore released by gravity, so purging the device 100. There is no risk of drops flowing out when the bottle 3 and the refill container 2 are uncoupled.

The invention claimed is:

1. A recharging device for recharging a bottle with liquid, comprising:

a refill container containing the liquid, the refill container comprising a neck; and a decanting system that selectively passes the liquid from the refill container to the bottle, said decanting system comprising a) a first part fixed to the neck of the refill container, the first part comprising an elongated first liquid conduit that provides passage therethrough of the only liquid and only in a first direction and a separate elongated first air conduit that provides passage therethrough of only air and only in a second direction opposite to the first direction, the first part being in communication with the refill container (2), the first liquid conduit and the first air conduit being arranged next to each other and spaced apart from each other in a side-by-side arrangement, b) a second part connected to the first part, the second part comprising a thread for directly screwing the second part to the bottle in a sealed arrangement, and unscrewing the second part from the bottle, said second part further comprising an elongated second liquid conduit that provides passage therethrough of only the liquid and only in the first direction and a separate elongated second air conduit that provides passage therethrough of only the air and only in the second opposite direction, the second liquid conduit and the second air conduit being arranged next to each other and spaced apart from each other in a side-by-side arrangement, said second part configured to communicate with the bottle with directly screwed to the second part, the first part and the second part being constrained to move together in translation and free to rotate between i) an open configuration in which said first and second liquid conduits and said first and second air conduits, respectively, are aligned, the open configuration providing for simultaneous passage, in opposite directions, of the liquid and the air between the refill container and the bottle respectively through the aligned separate first and second liquid conduits and the aligned first and second air conduits and in opposite directions for the liquid and air, and ii) a closed configuration in which said first and second liquid conduits and said first and second air conduits, respectively, are non-aligned and preventing the passage of the liquid and the air between the refill container and the bottle.

2. The recharging device according to claim 1, wherein, said second liquid conduit and the second air conduit have an equal length, and a length of the first liquid conduit is less than a length of the first air conduit sufficient to simultaneously ensure, in the open configuration, the passage of the liquid from the refill container to the bottle and the passage of the air from the bottle to the refill container.

3. The recharging device according to claim 1, wherein, the first part comprises a gadroon and the second part comprises a retractable lug, and in the closed configuration, the gadroon cooperates with the retractable lug so that, during screwing, the first part drives rotation of said second part.

4. The recharging device according to claim 3, wherein, locking elements are disposed in an area of the second part, and the locking elements arranged to be in contact with an upper end of the bottle in such a manner as to stop the rotation of the second part relative to the bottle when the upper end of the bottle reaches the locking elements.

5. The recharging device according to claim 4, wherein the first part comprises a screwing abutment that cooperates with a first abutment present on the second part so as to block rotation of the first part when the screwing abutment comes into contact with said first abutment, the first and second air conduits and the first and second liquid conduits, respectively, being disposed in such a manner as to be aligned when the screwing abutment comes into contact with said first abutment, the screwing abutment being disposed at a different level from the gadroon.

6. The recharging device according to claim 5, wherein the first part comprises an unscrewing abutment adapted to cooperate with a second abutment present on the second part so that, during unscrewing and once the unscrewing abutment is in contact with the second abutment, rotation of the first part drives rotation of the second part.

7. The recharging device according to claim 1, wherein the second part is constrained to move in translation with the first part by clipping elements.

8. The recharging device according to claim 1, wherein, the second part comprises a portion comprised of a receiving space having the thread and a shutting-off element extending at least inside the receiving space, said shutting-off element comprises said second air and liquid conduits, and said shutting-off element being nestable inside a neck of the bottle to enable, in the open configuration, the passage of the liquid into the bottle and the passage of the air out of the bottle.

9. The recharging device according to claim 1, wherein, the neck of the refill container is a threaded neck, and the first part comprises a first receiving area having a thread into which is screwed the threaded neck of the refill container.

10. The recharging device according to claim 1, wherein the first part comprises an anti-unscrewing element that prevents disassembly of the refill container and the first part.

11. The recharging device according to claim 9, wherein, the first part comprises a second receiving area adjacent said first receiving area along a longitudinal axis of said first part, and said first liquid conduit lies in the second receiving area and said first air conduit lies in both the first receiving area and the second receiving area.

12. The recharging device according to claim 11, wherein, in said second receiving area, said first air conduit and said first liquid conduit are surrounded by an air manifold that, in the closed configuration, communicates with said second air conduit and said second liquid conduit.

13. The recharging device according to claim 1, wherein, the second part is connected to the first part such that a user first rotating the first part drives the second part into rotation such that the thread of the second part is screwed directly to a thread of the bottle until achievement of a screwing operation whereupon the second part is blocked and prevented from further rotation about the thread of the bottle, and after the screwing operation with the second part being blocked, the user further rotating the first part only rotates the first part relative to the second part to thereby aligned the first and second liquid conduits and the first and second air conduits.

14. The recharging device according to claim 1, wherein, the first part is an external part and the second part is an internal part, the refill container carries the first part, in the closed configuration, the second part is housed in the first part, the second part is connected to the first part such that in a first screwing operation, a user first rotating the first part drives the second part into rotation such that the thread of the second part is screwed directly to a thread of the bottle until achievement of the first screwing operation whereupon the second part is blocked and prevented from further rotation about the thread of the bottle, and after the screwing operation with the second part being blocked, the user further rotating the first part only rotates the first part relative to the second part to thereby aligned the first and second liquid conduits and the first and second air conduits.

15. The recharging device according to claim 8, wherein, the first part is an external part and the second part is an internal part, the refill container carries the first part, the first part comprises a gadroon and the second part comprises a retractable lug, in the closed configuration, the gadroon cooperates with the retractable lug so that, during screwing, the first part drives rotation of said second part, the second part is connected to the first part such that in a first screwing operation, a user introduces the shutting off element into the neck of the bottle and then first rotating of the first part to drive the second part into rotation such that the thread of the second part is screwed directly to a thread of the bottle until achievement of the first screwing operation whereupon the second part is blocked and prevented from further rotation about the thread of the bottle, and after the screwing operation with the second part being blocked, the user further rotating the first part only rotates the first part relative to the second part to thereby aligned the first and second liquid conduits and the first and second air conduits.

16. A method of filling a bottle with a liquid, comprising the steps of:

providing a refill container containing the liquid, the refill container comprising a neck; and a decanting system that selectively passes the liquid from the refill container to the bottle, said decanting system comprising a) a first part fixed to the neck of the refill container, the first part comprising an elongated first liquid conduit that provides passage therethrough of the only liquid and only in a first direction and a separate elongated first air conduit that provides passage therethrough of only air and only in a second direction opposite to the first direction, the first part being in communication with the refill container (2), the first liquid conduit and the first air conduit being arranged next to each other and spaced apart from each other in a side-by-side arrangement, b) a second part connected to the first part, the second part comprising a thread for directly screwing the second part to the bottle in a sealed arrangement, and unscrewing the second part from the bottle, said second part further comprising an elongated second liquid conduit that provides passage therethrough of only the liquid and only in the first direction and a separate elongated second air conduit that provides passage therethrough of only the air and only in the second opposite direction, the second liquid conduit and the second air conduit being arranged next to each other and spaced apart from each other in a side-by-side arrangement, said second part configured to communicate with the bottle with directly screwed to the second part, the first part and the second part being constrained to move together in translation and free to rotate between i) an open configuration in which said first and second liquid conduits and said first and second air conduits, respectively, are aligned, the open configuration providing for simultaneous passage, in opposite directions, of the liquid and the air between the refill container and the bottle respectively through the aligned separate first and second liquid conduits and the aligned first and second air conduits and in opposite directions for the liquid and air, and ii) a closed configuration in which said first and second liquid conduits and said first and second air conduits, respectively, are non-aligned and preventing the passage of the liquid and the air between the refill container and the bottle, the second part being connected to the first part such that rotation of the first part drives the second part into rotation such that the thread of the second part is screwed directly to a thread of the bottle until achievement of a screwing operation whereupon the second part is blocked and prevented from further rotation about the thread of the bottle, and after the screwing operation with the second part being blocked, a further rotation of the first part only rotates the first part relative to the second part to thereby aligned the first and second liquid conduits and the first and second air conduits;

rotating the second part so that the first part drives the second part into the rotation such that the thread of the second part is screwed directly to the thread of the bottle until achievement of the screwing operation whereupon the second part is blocked and prevented from further rotation about the thread of the bottle, and after completing the screwing operation with the second part being blocked, further rotating the first part whereupon the first part rotates relative to the second part to thereby aligned the first and second liquid conduits and the first and second air conduits; and filling the bottle with the liquid by the aligned first and second liquid conduits providing the passage for the liquid from the refill contain to the bottle, and the first and second air conduits providing another, separate passage for the air from the bottle to the refill container.

17. The method according to claim 16, wherein, the first part is an external part and the second part is an internal part, the refill container carries the first part, and in the closed configuration, the second part is housed in the first part, the first part comprises a gadroon and the second part comprises a retractable lug, and in the closed configuration, the gadroon cooperates with the retractable lug so that, during screwing, the first part drives rotation of said second part.

18. A recharging device for recharging a bottle with liquid, comprising:

a refill container containing the liquid, the refill container comprising a neck; and a decanting system that passes the liquid from the refill container to the bottle, said decanting system comprising a) a first part fixed to the neck of the refill container, the first part comprising a first liquid conduit that passes therethrough of the liquid and in a first direction and a separate elongated first air conduit that passes therethrough air in a second direction opposite to the first direction, the first part being in communication with the refill container (2), the first liquid conduit being non-concentric with the first air conduit, b) a second part connected to the first part, the second part comprising a thread for directly screwing the second part to the bottle in a sealed arrangement, and unscrewing the second part from the bottle, said second part further comprising an elongated second liquid conduit that provides passage therethrough of only the liquid and only in the first direction and a separate elongated second air conduit that provides passage therethrough of only the air and only in the second opposite direction, the second liquid conduit being non-concentric with the second air conduit, said second part configured to communicate with the bottle with directly screwed to the second part, the first part and the second part being constrained to move together in translation and rotate between i) an open configuration in which said first and second liquid conduits and said first and second air conduits, respectively, are aligned, the open configuration providing for simultaneous passage of the liquid and the air between the refill container and the bottle respectively through the aligned separate first and second liquid conduits and the aligned first and second air conduits and in opposite directions for the liquid and air, and ii) a closed configuration in which said first and second liquid conduits and said first and second air conduits, respectively, are non-aligned and preventing the passage of the liquid and the air between the refill container and the bottle.

* * * * *